US006253572B1

(12) United States Patent
Bottum, Sr. et al.

(10) Patent No.: US 6,253,572 B1
(45) Date of Patent: Jul. 3, 2001

(54) NON-DRIP SUCTION ACCUMULATOR, RECEIVER AND HEAT EXCHANGER

(75) Inventors: Edward W. Bottum, Sr.; Edward W. Bottum, Jr., both of Brighton, MI (US)

(73) Assignee: Refrigeration Research, Inc., Brighton, MI (US)

( * ) Notice: Subject to any disclaimer, the term of this patent is extended or adjusted under 35 U.S.C. 154(b) by 0 days.

(21) Appl. No.: 09/419,556

(22) Filed: Oct. 18, 1999

(51) Int. Cl.[7] ..... F25B 39/04
(52) U.S. Cl. ..... 62/509; 62/513
(58) Field of Search ..... 62/503, 509, 513, 62/267

(56) References Cited

U.S. PATENT DOCUMENTS 3,084,523 4/1963 Bottum et al. .
3,212,289 10/1965 Bottum .
5,479,790 1/1996 Bottum, Jr. et al. .
5,722,146 3/1998 Seigle et al. .

FOREIGN PATENT DOCUMENTS 2-275267 * 11/1990 (JP) ..... 62/503

* cited by examiner

*Primary Examiner*—Michael Powell Buiz
*Assistant Examiner*—Melvin Jones
(74) *Attorney, Agent, or Firm*—MacMillan, Sobanski & Todd, LLC

(57) ABSTRACT

A suction accumulator for a refrigeration system includes a pair of closed shells arranged in spaced relation one within the other to define a space therebetween effective to prevent sweating of the inner shell during performance of its normal suction accumulator function. The space is connected between the condenser and the expansion valve of the system to function as a receiver for warm refrigerant thereby creating heat exchange through the wall of the inner shell.

10 Claims, 3 Drawing Sheets

NON-DRIP SUCTION ACCUMULATOR, RECEIVER AND HEAT EXCHANGER

BACKGROUND OF THE INVENTION

The present invention relates generally to a suction accumulator for a refrigeration system and, in particular, to a suction accumulator that also functions as a receiver and a heat exchanger.

It is known in the art to which this invention pertains to provide a suction accumulator between the evaporator and compressor of a refrigeration system in order to protect the compressor from possible damage. Vaporized refrigerant is received from the evaporator and passed on through the suction accumulator to the compressor. Any raw liquid is metered back to the compressor at a rate that will not result in damage to the compressor.

In recent years, primarily for reasons of energy savings and improved efficiency, it has often become the practice to flood the evaporator, or "low side" of the refrigeration suction accumulator, wherein evaporation takes place, reducing the surface temperature of the accumulator below ambient dew point, which causes sweating of the accumulator surfaces. Sweating of the accumulator ultimately leads to rusting, and possible accumulation of water on surfaces beneath the accumulator.

One expedient that has been employed in an effort to eliminate the sweating and ultimate rusting problems has been to wrap or encase the suction accumulator with one or more layers of insulation. However, this is costly from a material and labor standpoint. Also, difficulty has been encountered in providing an airtight insulative seal, ultimately resulting in the described sweating and rusting problems.

It has further been proposed to position a suction accumulator within a receiver, and to admit into the space therebetween high temperature liquid refrigerant from the condenser. A structural arrangement of this character is shown in the U.S. Pat. No. 3,212,289. As is described herein, the relatively warm refrigerant prevents moisture in the atmosphere from condensing on the accumulator which contains relatively cold refrigerant. The patented arrangement also provides an efficient heat exchange between the relatively cold low pressure refrigerant in the accumulator and the relatively warm high pressure refrigerant in the receiver.

The provision of a dead air space between a suction accumulator and a surrounding sealed vessel or container is effective to a large degree in precluding sweating and subsequent rust formation upon the accumulator walls. The insulative property of the space provided by the novel structure of this invention may be further enhanced by evacuating the space. The structure resulting may be considered similar to that of a vacuum Thermos bottle. Additionally, enhancement of the novel purposes of this invention may be accomplished by provision of means effective to prevent sweating of the inlet and outlet connections to and from the suction accumulator. These concepts are shown in the U.S. Pat. No. 5,479,790.

SUMMARY OF THE INVENTION

Significant advantages result by combining into a single unit a suction accumulator and receiver, or even more advantageously, a suction accumulator, receiver and heat exchanger into a unitary structure. The functions of each are achieved in a single body, and thereby the costs of each as separate units are eliminated, with the further advantage of substantial space savings.

The suction accumulator, receiver and heat exchange apparatus according to the present invention is used in a refrigeration system having a condenser connected between an outlet of a compressor and an inlet of an expansion valve and an evaporator connected between an outlet of the expansion valve and an inlet of the compressor. The apparatus includes: a tubular outer shell having opposite ends closed by an upper closure and a lower closure and a pair of connector means extending through a side wall of the outer shell; a tubular inner shell positioned interiorly of the outer shell and having an upper end portion extending outside the outer shell through an opening formed in the upper closure, the inner shell having a closed lower end and an upper end having a pair of tube openings formed therein; a generally U-shaped outlet tube positioned interiorly of the inner shell and having one end extending through one of the tube openings; and an inlet tube positioned interiorly of the inner shell and having one end extending through another one of the tube openings. When the connector means are connected to the outlet of the condenser and the inlet of the expansion valve, the outer shell functions as a refrigeration system receiver receiving warm refrigerant from the condenser, and when the one end of the inlet tube is connected to an outlet of the evaporator and the one end of the outlet tube is connected to the inlet of the compressor, the inner shell functions as a suction accumulator receiving cool refrigerant from the evaporator, and heat exchange occurs between the warm refrigerant and the cool refrigerant through a side wall of the inner shell. The inner shell can be formed of a copper material to increase heat exchange.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
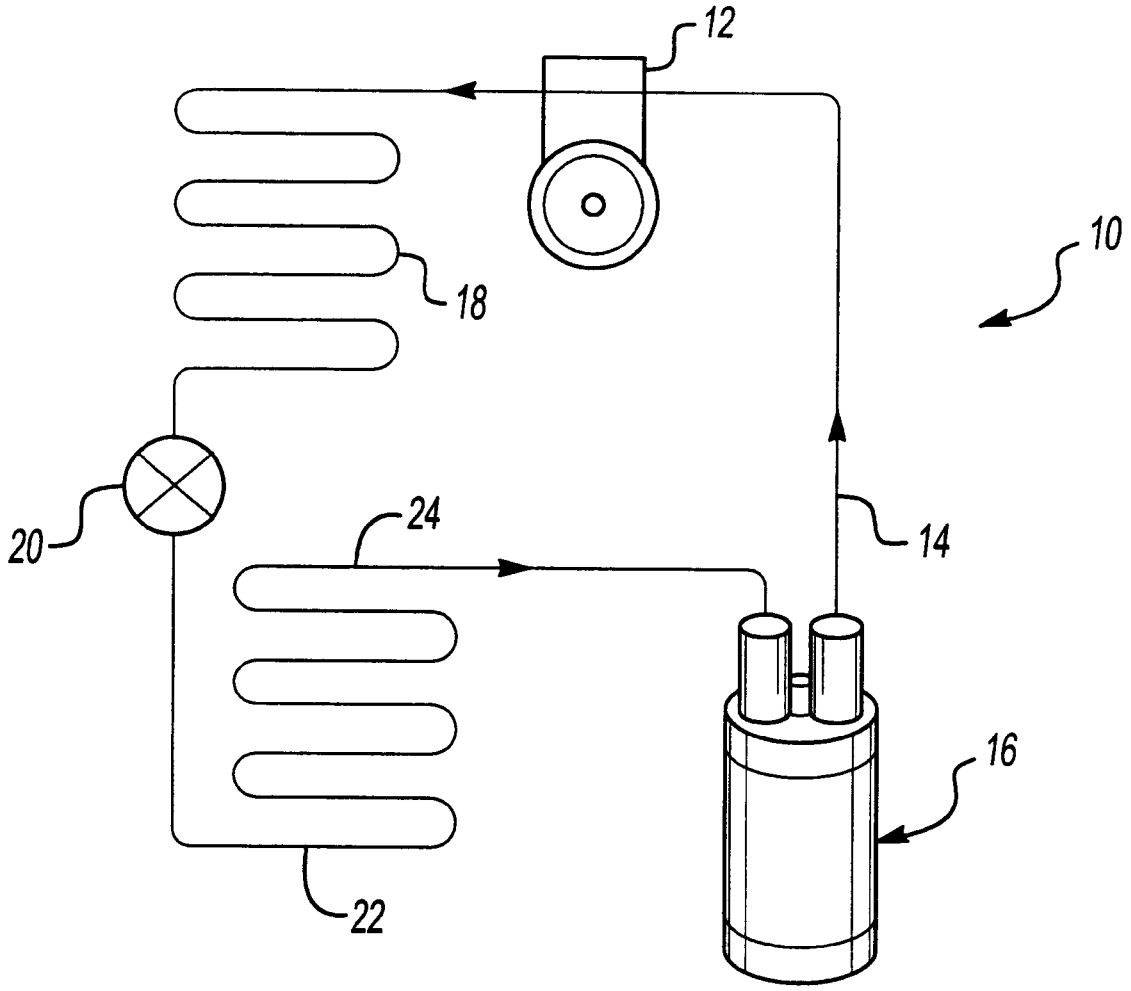
Fig-1 PRIOR ART
FIG. 1 is a schematic diagram of a conventional refrigeration system representing an illustrative environment for a suction accumulator in accordance with the present invention.

There is shown in the FIG. 1 a conventional refrigeration system 10 charged with a refrigerant material. As is normal, a compressor 12 receives a gaseous refrigerant material through a suction conduit means 14 from an outlet of a suction accumulator 16. The gaseous refrigerant is compressed and passes from the compressor 12 to a condenser 18. The refrigerant is condensed to a liquid state at the condenser 18, and passes through an expansion valve 20 whereat its temperature and pressure are reduced. The cooled refrigerant then passes to an evaporator 22, wherein it is vaporized by absorbing heat, and then enters the suction accumulator 16 through a conduit means 24.

In recent years, there is an increasing tendency, ascribed to energy savings and efficiency requirements, to flood the "low side" of the refrigeration system shown in the FIG. 1, and more particularly the evaporator 22 shown therein. This causes liquid refrigerant to almost continuously spill back into the suction accumulator 16. Evaporation of this liquid in the accumulator 16 reduces its surface temperature often below the ambient dew point, causing constant sweating of the accumulator surface. This constant sweating ultimately results in rusting of the accumulator 16, and further, the deposition of undesirable pools of water on the surface beneath the accumulator.

Figure 2:
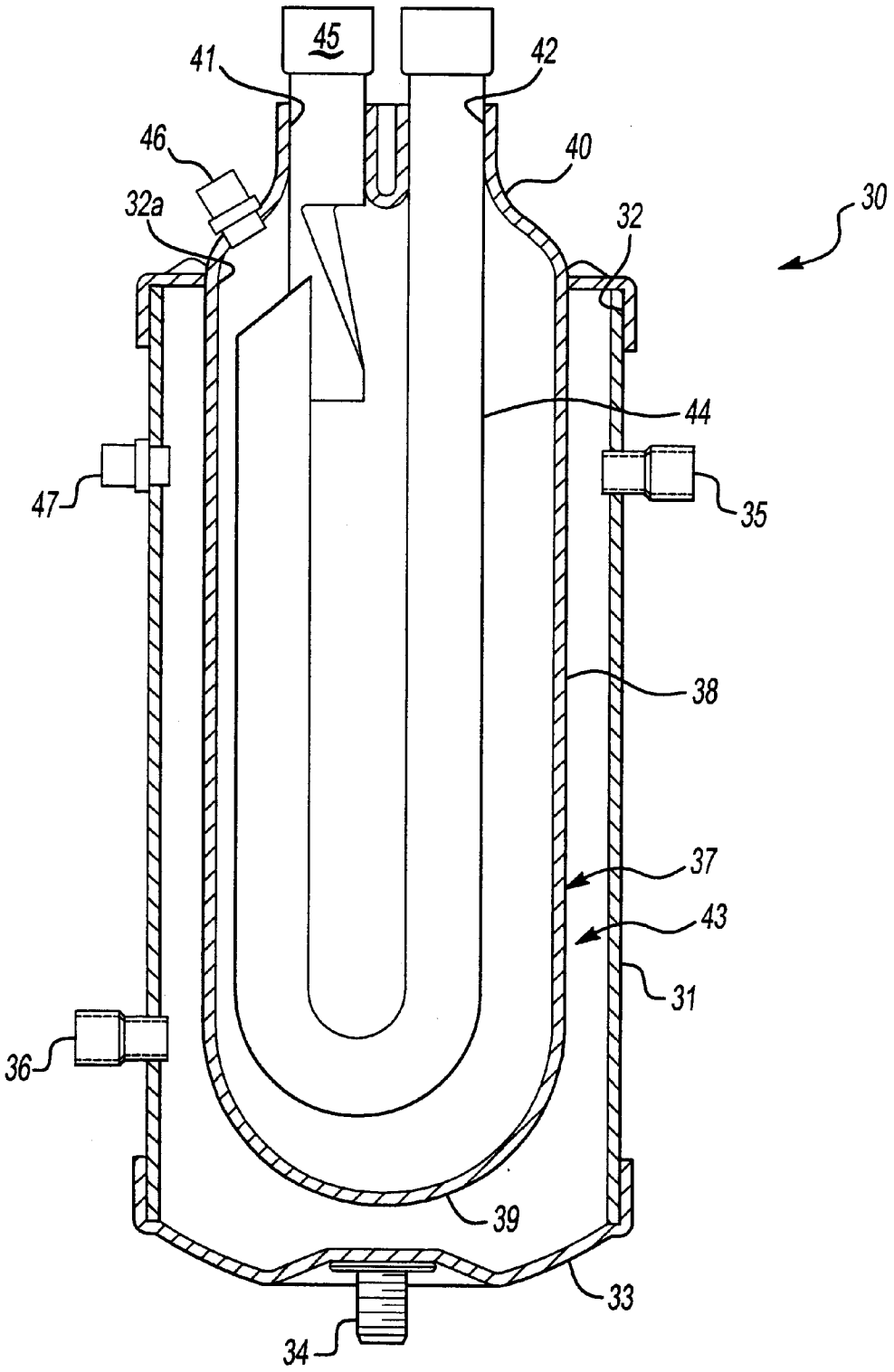
FIG. 2 is a side elevational view in cross section of a suction accumulator according to the present invention.

Applicants have discovered that these problems are effectively overcome, and other advantageous results achieved, by utilization of a suction accumulator assembly according to the present invention substantially as shown in FIG. 2 of the drawings. The accumulator assembly is designated generally therein by the numeral 30, and comprises a tubular outer shell 31, of generally cylindrical shape, sealed essentially hermetically at opposite ends by cap or closure means including an upper outer shell closure 32 and a lower outer shell closure 33. The outer shell closures 32 and 33 are generally cup-shaped and have side walls engaging outer end surfaces of the shell 31. The outer shell 31 functions in the nature of a receiver in the present invention, and may support a threaded mounting means 34 attached to the lower closure 33 as is conventional in the art. Provided on the outer shell 31, at any desired location thereon, are a pair of passages or open-ended connector means 35 and 36, constructed to be sealed or rendered airtight when required. The function of the connector means 35 and 36 is to connect the interior of the outer shell 31 between the condenser 18 and the expansion valve 20 of the system 10 shown in the FIG. 1.

Located interiorly of the shell 31 is a suction accumulator 37 in the form of a tubular, generally cylindrical shell 38 having a hemispherical closed lower end 39 and a reduced diameter upper end 40 with a pair of tubular extension openings 41 and 42. An upper end portion of the inner shell 38 extends through a central opening 32*a* formed in the upper outer shell closure 32 such that the reduced diameter upper end 40 is positioned outside the outer shell 31. The inner shell 38 typically is of spun construction. As shown, the outer shell 31 and the inner shell 38 are coaxially spaced to provide an annular space 43 for fluid, which may be 25 vacuum, air, gas or liquid, depending upon the particular function or mode of operation selected for the suction accumulator assembly 30. The relatively warm refrigerant leaving the condenser 18 is warmer than the surrounding atmosphere at ambient temperature and thereby prevents moisture in the air from condensing on the external surface of the outer shell 31. There is heat exchange between the warm refrigerant in the space 43 and the cooler refrigerant in the inner shell 38 through the wall of the inner shell. The shells 31 and 38 are typically formed of a steel material. This heat exchange can be increased by forming the inner shell 38 of a material having higher heat conductivity such as, for example, a copper material.

Disposed within the inner shell 38 of the suction accumulator 37 and suitably supported therein is a generally U-shaped outlet tube 44. One end of the tube 44 is mounted in and extends through the tube opening 42 for connection to the suction conduit means 14 leading to compressor 12 of the system 10. Similarly, an inlet tube 45 is mounted in and extends through the tube opening 41 for connection to the conduit means 24 leading to the evaporator 22 of the system 10. Thus, the suction accumulator 30 according to the present invention replaces the conventional suction accumulator 16 in the refrigeration system 10 shown in the FIG. 1. As such, the suction accumulator assembly 30 as constructed in the manner shown in the FIG. 2 is effective to substantially entirely avoid the sweating problem of conventional suction accumulators earlier described.

A fuisible plug 46 can be mounted in an opening formed in the wall of the upper end 40 of the inner shell 38 and is useful for permitting the communication of gas from the interior of the inner shell to the atmosphere. The plug 46 has an internal wall (not shown) blocking such communication until the internal wall melts at a predetermined temperature to allow gas to escape and prevent an explosion. A similar fusible plug 47 can be mounted in an opening formed in the wall of the outer shell 31 and is useful for permitting the communication of gas from the space 43 to the atmosphere.

Figure 3:
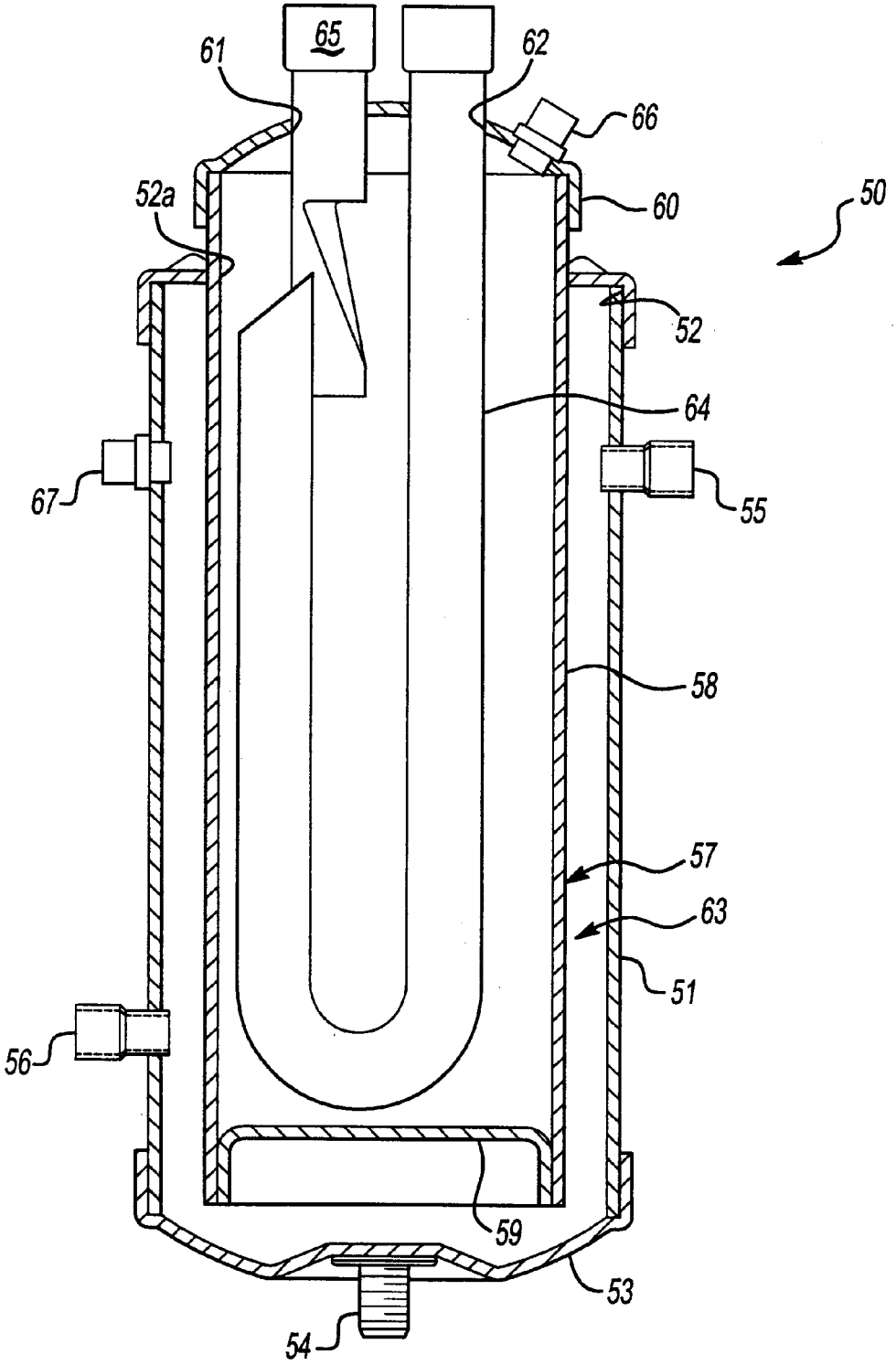
FIG. 3 is a side elevational view in cross section of an alternate embodiment of the suction accumulator according to the present invention.

There is shown in the FIG. 3 of the drawings an alternate embodiment suction accumulator assembly 50 comprising a tubular, generally cylindrical outer shell 51, sealed essentially hermetically at opposite ends by closure means including an upper outer shell closure 52 and a lower outer shell closure 53. The closures 52 and 53 are generally cup-shaped and have side walls engaging outer end surfaces of the shell 51. The outer shell 51 functions in the nature of a receiver in the present invention, and may support a threaded mounting means 54 attached to the lower closure 53. Provided on the outer shell 51, at any desired location thereon, are a pair of passages or open-ended connector means 55 and 56, constructed to be sealed or rendered airtight when required. The function of the connector means 55 and 56 is to connect the interior of the outer shell 51 between the condenser 18 and the expansion valve 20 of the system 10 shown in the FIG. 1.

Located interiorly of the shell 51 is a suction accumulator 57 of tube and cap construction. A tubular, generally cylindrical shell 58 has upper and lower end openings. The lower end opening is sealed by a cup-shaped lower inner shell closure 59 inverted and inserted into the opening with a side wall engaging an interior end surface of the inner shell 58. The upper end opening is sealed by a cup-shaped upper inner shell closure 60 having a side wall engaging an outer end surface of the inner shell 58. An upper end portion of the inner shell 58 extends through a central opening 52*a* formed in the upper outer shell closure 52 such that the upper inner shell closure 60 is positioned outside the outer shell 51. A pair of tube openings 61 and 62 are formed in the upper inner shell closure 60. As shown, the outer shell 51 and the inner shell 58 are coaxially spaced to provide an annular space 63 for fluid, which may be vacuum, air, gas or liquid, depending upon the particular function or mode of operation selected for the suction accumulator assembly 50.

Disposed within the inner shell 58 of the suction accumulator 57 and suitably supported therein is a generally U-shaped outlet tube 64. One end of the tube 64 is mounted in and extends through the tube opening 62 for connection to the suction conduit means 14 leading to compressor 12 of the system 10. Similarly, an inlet tube 65 is mounted in and extends through the tube opening 61 for connection to the conduit means 24 leading to the evaporator 22 of the system 10. Thus, the suction accumulator 50 according to the present invention replaces the conventional suction accumulator 16 in the refrigeration system 10 shown in the FIG. 1. As such, the suction accumulator assembly 50 as constructed in the manner shown in the FIG. 3 is effective to substantially entirely avoid the sweating problem of conventional suction accumulators earlier described.

A fusible plug 66 can be mounted in an opening formed in the wall of the upper inner shell closure 60 and is useful for permitting the communication of gas from the interior of the inner shell 58 to the atmosphere. The plug 66 has an internal wall (not shown) blocking such communication until the internal wall melts at a predetermined temperature to allow gas to escape and prevent an explosion. A similar fusible plug 67 can be mounted in an opening formed in the wall of the outer shell 51 and is useful for permitting the communication of gas from the space 63 to the atmosphere.

The suction accumulator assemblies 30 and 50 each function as a suction accumulator, receiver and heat exchanger with high efficiency and non-drip operation.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A suction accumulator, receiver and heat exchange apparatus for use in a refrigeration system having a condenser connected between an outlet of a compressor and an inlet of an expansion valve and an evaporator connected between an outlet of the expansion valve and an inlet of the compressor, comprising:

a tubular outer shell having opposite ends closed by an upper closure and a lower closure and a pair of connector means extending through a side wall of said outer shell;

a tubular inner shell positioned interiorly of said outer shell and having an upper end portion extending outside said outer shell through an opening formed in said upper closure, said inner shell having a closed lower end and an upper end having a pair of tube openings formed therein;

a generally U-shaped outlet tube positioned interiorly of said inner shell and having one end extending through one of said tube openings; and an inlet tube positioned interiorly of said inner shell and having one end extending through another one of said tube openings whereby when said connector means are connected to an outlet of the condenser and the inlet of the expansion valve, said outer shell functions as a refrigeration system receiver receiving warm refrigerant from the condenser, and when said one end of said inlet tube is connected to an outlet of the evaporator and said one end of said outlet tube is connected to the inlet of the compressor, said inner shell functions as a suction accumulator receiving cool refrigerant from the evaporator, and heat exchange occurs between the warm refrigerant and the cool refrigerant through a side wall of said inner shell.

2. The apparatus according to claim 1 wherein said inner shell is formed of a copper material.

3. The apparatus according to claim 1 wherein said inner shell is formed as a tube having opposite end openings and including an inverted generally cup-shaped lower end closure attached inside and closing a lower one of said end openings and a cup-shaped upper end closure attached outside and closing an upper one of said end openings.

4. The apparatus according to claim 1 wherein said inner shell is of spun construction.

5. The apparatus according to claim 4 wherein said inner shell has a hemispherical lower end and said tube openings are formed as tubular extensions.

6. The apparatus according to claim 1 including a fusible plug extending through a wall of said inner shell exteriorly of said outer shell.

7. The apparatus according to claim 1 including a fusible plug extending through said side wall of said outer shell.

8. The apparatus according to claim 1 including a mounting means attached to said lower closure of said outer shell.

9. A suction accumulator, receiver and heat exchange apparatus for use in a refrigeration system, comprising:

a tubular outer shell having opposite ends closed by an upper closure and a lower closure and a pair of connector means extending through a side wall of said outer shell;

a first fusible plug extending through said side wall of said outer shell a tubular inner shell positioned interiorly of said outer shell and having an upper end portion extending outside said outer shell through an opening formed in said upper closure, said inner shell having a closed lower end and an upper end having a pair of tube openings formed therein;

a generally U-shaped outlet tube positioned interiorly of said inner shell and having one end extending through one of said tube openings;

an inlet tube positioned interiorly of said inner shell and having one end extending through another one of said tube openings; and a second fusible plug extending through a wall of said upper end portion of said inner shell.

10. The apparatus according to claim 9 wherein said inner shell is formed of a copper material.

* * * * *